US006299138B1

(12) United States Patent
Huang et al.

(10) Patent No.: US 6,299,138 B1
(45) Date of Patent: Oct. 9, 2001

(54) DIRECTLY DRIVING ELECTROMOTIVE JACK DEVICE FOR RELEASING TORSIONAL FORCE

(75) Inventors: Chen-Ti Huang, P.O. Box 82-144; Ching-Hsing Chou, both of Taipei (TW)

(73) Assignees: Chen-Ti Huang; Yung-Fu Lee, both of (TW)

( * ) Notice: Subject to any disclaimer, the term of this patent is extended or adjusted under 35 U.S.C. 154(b) by 0 days.

(21) Appl. No.: 09/621,865

(22) Filed: Jul. 21, 2000

(30) Foreign Application Priority Data

Jul. 23, 1999 (TW) ..... 88212421

(51) Int. Cl.[7] ..... B66F 3/00

(52) U.S. Cl. ..... 254/126; 254/DIG. 2; 254/103

(58) Field of Search ..... 254/126, DIG. 2, 254/425, 424, 103

(56) References Cited

U.S. PATENT DOCUMENTS

| | | | | |
|---|---|---|---|---|
| 4,653,727 | * | 3/1987 | Chang et al. | 254/126 |
| 4,941,797 | * | 7/1990 | Smillie, III | 254/126 |
| 4,943,034 | * | 7/1990 | Wagnon | 254/122 |
| 5,580,207 | * | 12/1996 | Kiebooms et al. | 254/126 |
| 5,707,043 | * | 1/1998 | Yoshida | 254/126 |
| 6,029,950 | * | 2/2000 | Yeh | 254/126 |

* cited by examiner

*Primary Examiner*—Joseph J. Hail, III
*Assistant Examiner*—Leo Wilson
(74) *Attorney, Agent, or Firm*—A & J

(57) ABSTRACT

A directly driving electromotive jack device for releasing a torsional force comprises a jack with a driving screw rod, an electromotive motor arranged with a deceleration gearbox, a torsional force releasing means directly connected to a positioning plate and the jack, a power supply directly switch operable by an operator. The torsional force releasing means serves to connect the electromotive motor with the jack. The torsional force releasing means comprises a positioning plate for fixing the electromotive motor; two or more than two symmetric arms of torsional force; a bearing for being passed through the electromotive motor; and a switch connected to the driving screw rod. The electromotive motor is fixed to the positioning plate by a plurality of studs. The arms of torsional force serve to connect the positioning plate with pivotal shafts of the jack. The rotary shaft of the electromotive motor and the driving screw rod are positioned in a same central line. The driving screw rod passes through the bearing and the sleeve. The bearing is fixed on the pivotal shafts and is positioned between the pivotal shafts and the sleeve; and the sleeve is connected with the rotary shaft of the electromotive motor. The aforesaid torsional force releasing means serves to combine the rotary shaft of the electromotive motor with the sleeve. When the rotary shaft of the electromotive motor rotates, the torsional force can be cancelled by the torsional force releasing means for preventing the jack from generating a strain or being tilt; moreover, by a switch of a power source to control the direction of the current flow, the jack can be lifted or descended.

3 Claims, 8 Drawing Sheets

DIRECTLY DRIVING ELECTROMOTIVE JACK DEVICE FOR RELEASING TORSIONAL FORCE

FIELD OF THE INVENTION

The present invention relates to a directly driving electromotive jack device for releasing a torsional force, which can be carried in a car; and the electromotive jack can be lifted or descended through a simple and convenient operation by the user.

BACKGROUND OF THE INVENTION

The current used jack used in a small car is almost operated manually. The operation way is to shake a bow shape handle to lift or descend an arm of the jack. In operating process, it is often that the jack is tilt due to an improper force applied thereon. Thus, a large force is necessary. This is difficult for a women. Besides, the prior art jack has a large volume or a heavy weight for enhancing the stability thereof. This is a larger burden to a women.

Therefore, electromotive jacks are developed. However, some torsional force releasing means are necessary to be connected between the jack and the motor. Since the structure is complex, and the cost is high and heavy burdens can not be lifted, Therefore, this prior art electromotive jack does not be used widely. Moreover, a motor with larger power and a heavy weight is used, and therefore, it is hard for a women to transfer it.

Therefore, there is an eager demand for a novel directly driving electromotive jack device for releasing a torsional force so as to improve the aforesaid defects in the prior art.

SUMMARY OF THE INVENTION

Accordingly, the primary object of the present invention is to provide a directly driving electromotive jack device for releasing a torsional force; wherein the torsional force releasing means comprises a positioning plate for fixing the electromotive motor; two or more than two symmetric arms of torsional force; a bearing for passing through the electromotive motor; a switch connected to the driving screw rod. The electromotive motor is fixed to the positioning plate by a plurality of studs. The arms of torsional force serve to connect the positioning plate with pivotal shafts of the jack. The rotary shaft of the electromotive motor and the driving screw rod are positioned in a same central line. The driving screw rod passes through the bearing and the sleeve. The bearing is fixed on the pivotal shafts and is positioned between the pivotal shafts and the sleeve; and the sleeve is connected with the rotary shaft of the electromotive motor.

The aforesaid torsional force releasing means serves to combine the rotary shaft of the electromotive motor with the sleeve. When the rotary shaft of the electromotive motor rotates, the torsional force can be cancelled by the torsional force releasing means for preventing the jack from generating a strain or being tilt; moreover, by a switch of a 12 to 15 volts DC power source in a car to control the direction of the current flow, the jack can be lifted or descended.

The present invention has the following effect:

1. A car or a heavy article can be lifted upwards steadily and safely.
2. The present invention has a simple structure and a lightweight so that a woman can operate the present invention.
3. The operation of the present invention is simple, the operator is only necessary to switch the direction of the jack, then the jack can be lifted or descended.

4. After the torsional force is released, the jack is prevented from staining or tilting.
5. The present invention can be mass-produced, and thus the manufacturing cost is lowered.

The various objects and advantages of the present invention will be more readily understood from the following detailed description when reading in conjunction with the appended drawing.

BRIEF DESCRIPTION OF THE DRAWINGS

FIG. 31B is an enlarged view of the torsional force releasing means shown in FIG. 3A.

DETAILED DESCRIPTION OF THE PREFERRED EMBODIMENTS

In the following, the preferred embodiment of the present invention will be described with the append figures.

Figure 1:
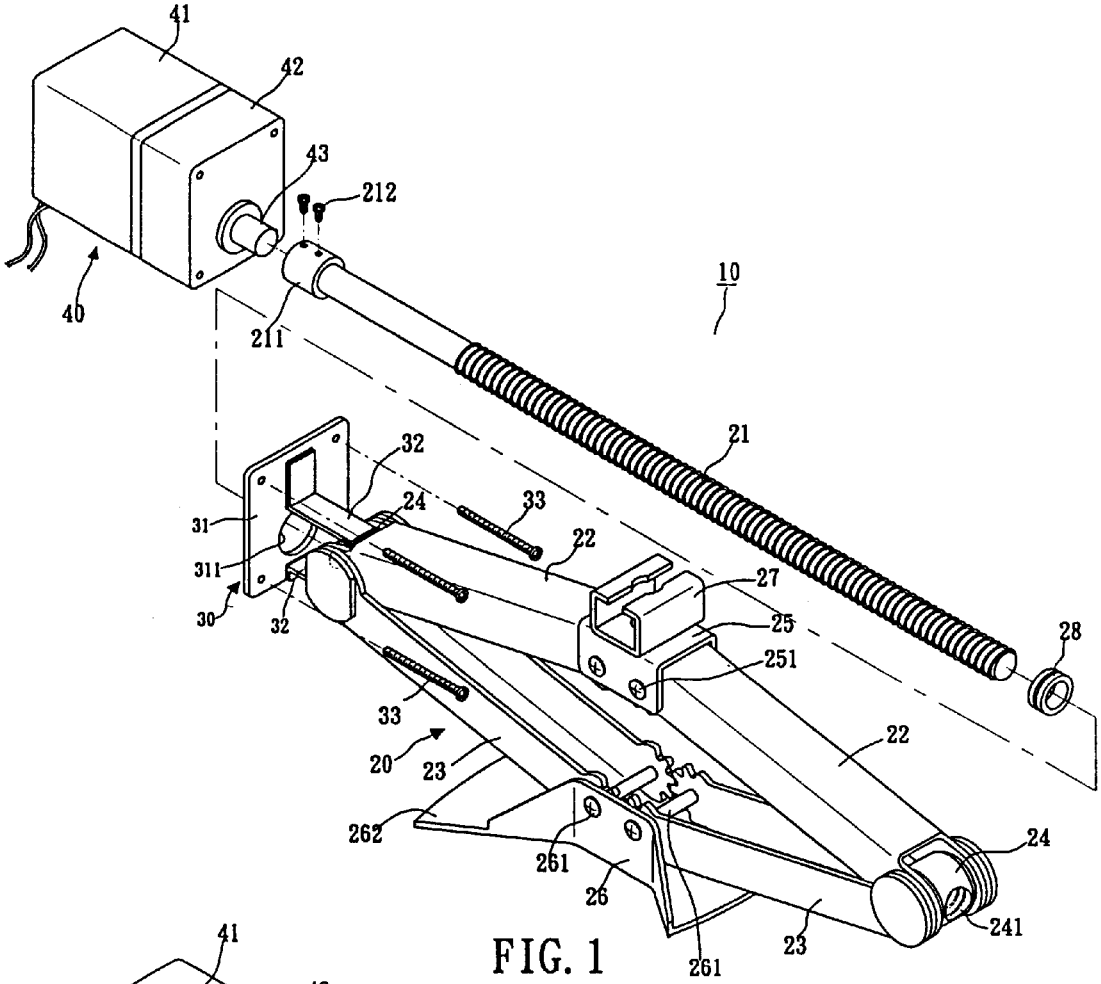
FIG. 1 is an exploded perspective view of the electromotive jack of the present invention.
Figure 2:
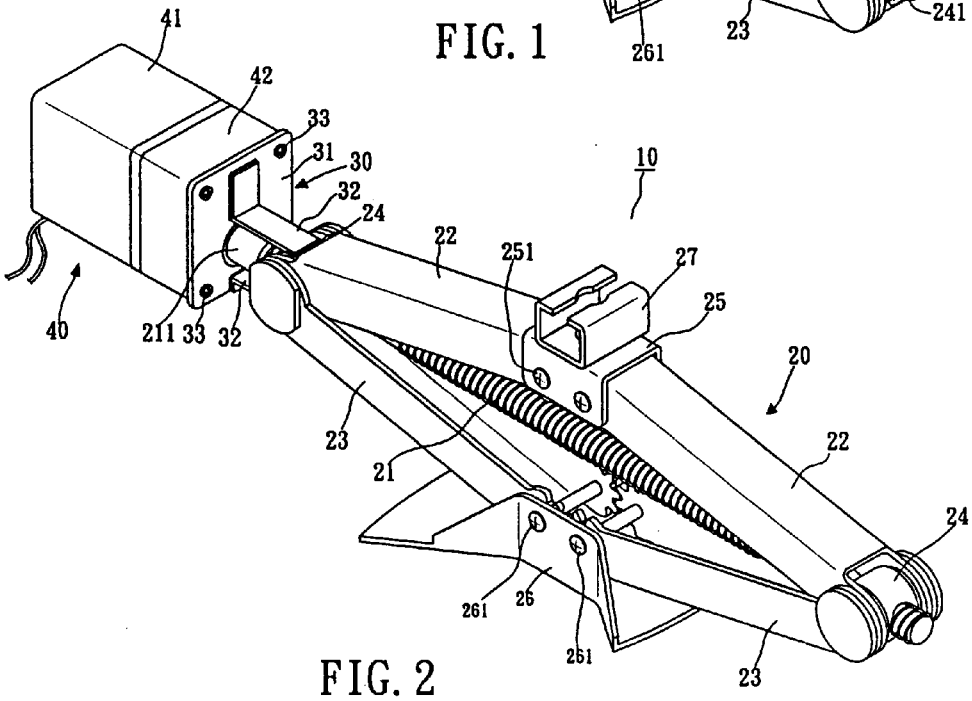
FIG. 2 is an assembled perspective view of the electromotive jack in the present invention.

With reference to FIGS. 1 and 2, the exploded perspective view and assembly view of the electromotive jack in the present invention are illustrated. In these figures, an electromotive jack 10 includes a jack 20, a torsional force releasing means 30, an electromotive motor 40 and a driving screw rod 21. The jack 20 is formed by two upper lifting arms 22, two lower lifting arms 23, two pivotal shafts 24 connecting to the upper lifting arms and lower lifting arms, a connecting block 25 being connected to the two upper lifting arms by the axial stud 251, a seat 261 fixed to the two lower lifting arms by the axial stud 261, a top pad 27 fixed to the connecting block, and a driving screw rod 21 passing through the two pivotal shafts, and a bearing 28 being passed through by the driving screw rod. When the driving rod 21 rotates in different directions, the pivotal shafts 24 will lift or descend. This jack is a prior art design. However, the structure, function, and operation are performed along prior art ways. Thus, the detail will not be described in the following.

The electromotive motor 40 is formed by a small type motor 41 and a deceleration gearbox 42. In the deceleration gearbox 42, a deceleration gearbox is formed by star gears or by worms or worm gears. Besides, a sleeve 211 serves to connect the rotary shaft 43 and the driving screw rod 21 of the electromotive motor. Further, a stud 212 (or a pin, or a key) are used to fix the two components.

The torsional force releasing means 30 includes a positioning plate 31 for fixing the electromotive motor and two arms 32 of torsional force, a bearing 28 on the driving screw rod 21 (see FIG. 3A) and a sleeve 211. The arm of torsional force has an approximate L shape. The horizontal end thereof may be welded with the pivotal shafts 24. The vertical end thereof is welded with the positioning plate 31. A plurality of studs 33 serve to fix the positioning plate 31 to the electromotive motor 40. A through hole 311 is formed in the center of the positioning plate for being passed through by the rotary shaft 43 of the electromotive motor. Moreover, the driving screw rod 21 passes through the bearing 28 to be connected to the sleeve 211. Furthermore, the bearing 28 is welded to the pivotal shaft 24.

Figure 3A:
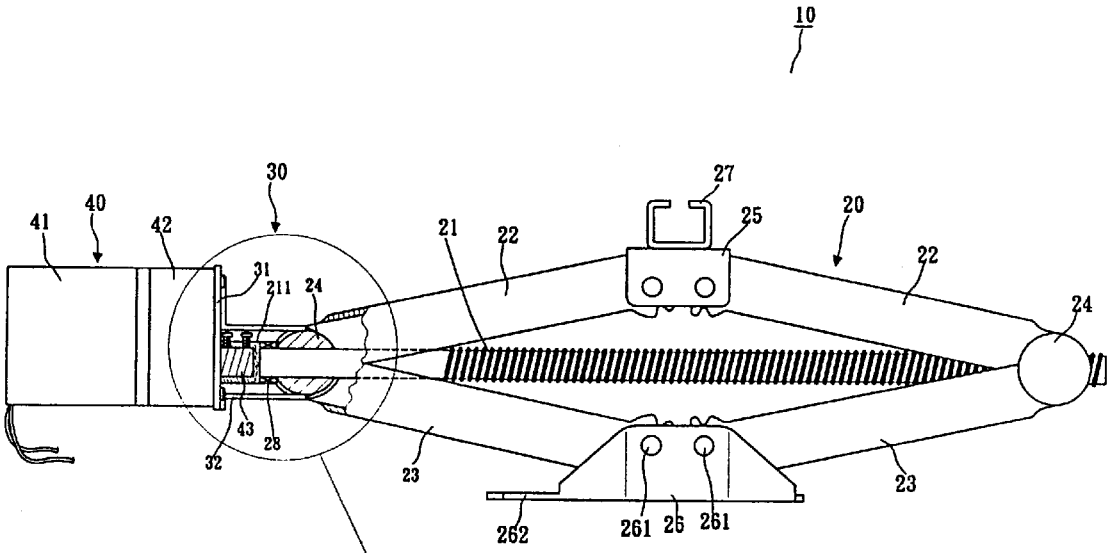
FIG. 3A is a partial cross sectional view of the electromotive jack in the present invention after being assembled.
Figure 3B:
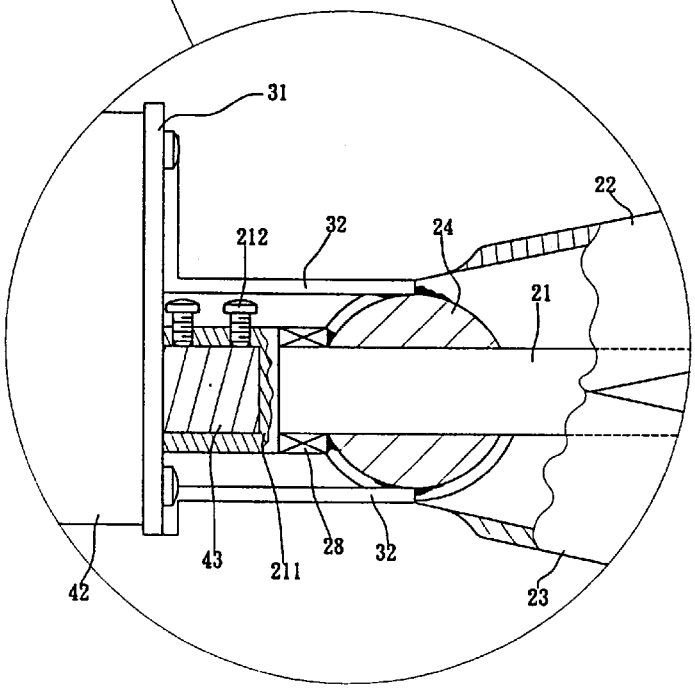

Referring to FIGS. 3A and 3B, when the small type motor 41 drives the deceleration gearbox 42 to further drive the driving screw rod 21, the torque from the electromotive motor 40 must be cancelled by the torsional force releasing means 30. By canceling the torque, the stability is increased for preventing the jack 20 from being tilt due to instability of the center of gravitation. Besides, one end of the seat 26 is extended with a prolonging block 262 with a larger area. The prolonging block 262 is like a sector or a rectangular. The prolonging block serves to prevent the center of gravitation of the electromotive motor 40 from instability before conduction of the electromotive motor 40 so as to be balanced as it is grounded.

Figure 4:
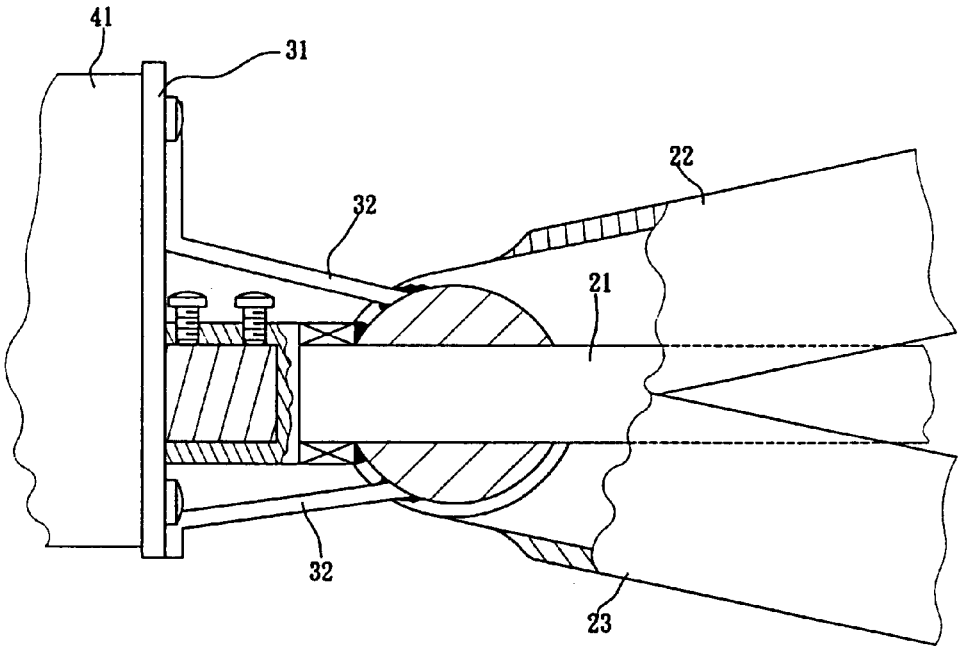
FIG. 4 shows the structure of another torsional force releasing means in the present invention.
Figure 5:
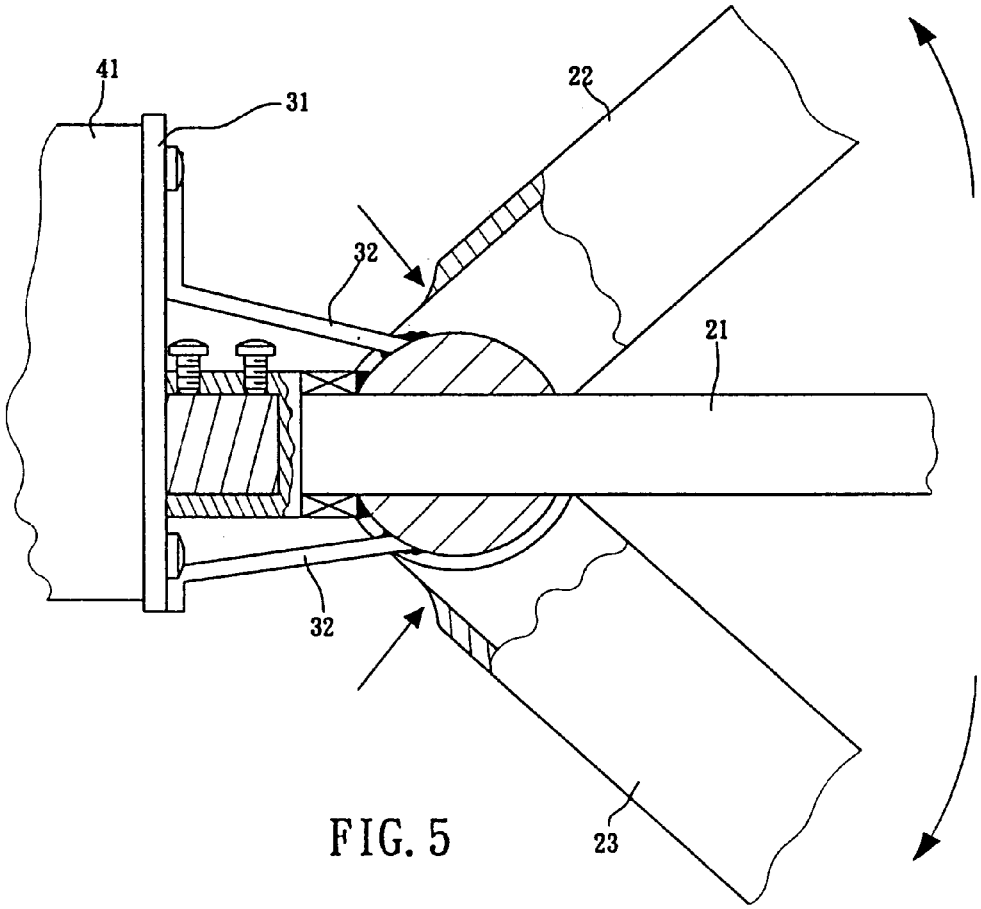
FIG. 5 shows the structure of the torsional force releasing means in the present invention as the jack is lifted.

One end of the aforesaid arm 32 of torsional force is a horizontal end. It can be installed with a small tilt angle. This angle is within a range of 30 degrees (see FIG. 4). If the angle is over 30 degrees, then as the upper lifting arm 22 and lower lifting arm 23 are lifted, the end portion (as shown by the arrow in the figure) of the lifting arm near the pivotal shaft 24 will collide the 32 of torsional force so as not to be lifted. If the angle is small than 30 degrees, then it will not collide the arm 32 of torsional force (see FIG. 5) and thus it can be lifted or descended successfully.

Figure 6:
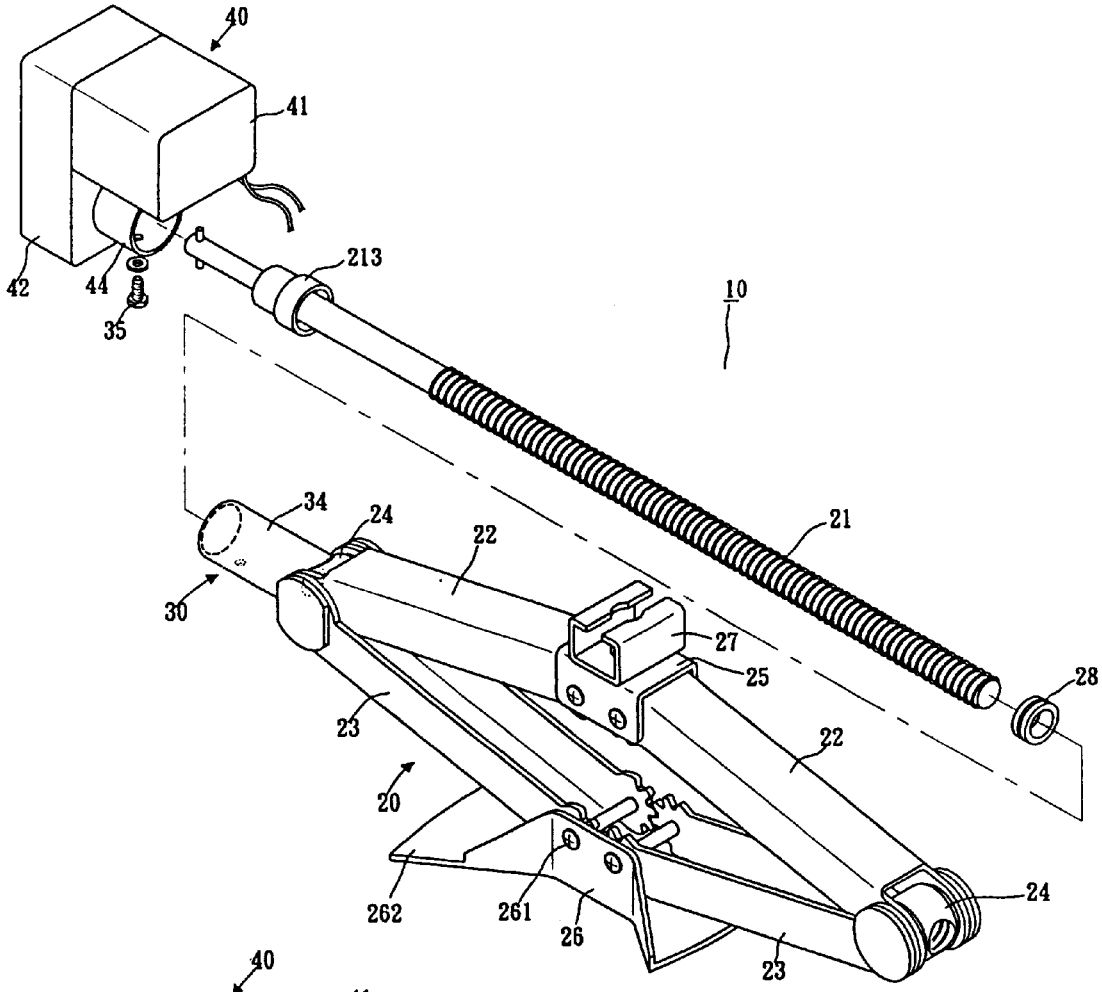
FIG. 6 is an exploded perspective view of the electromotive jack in the present invention.
Figure 7:
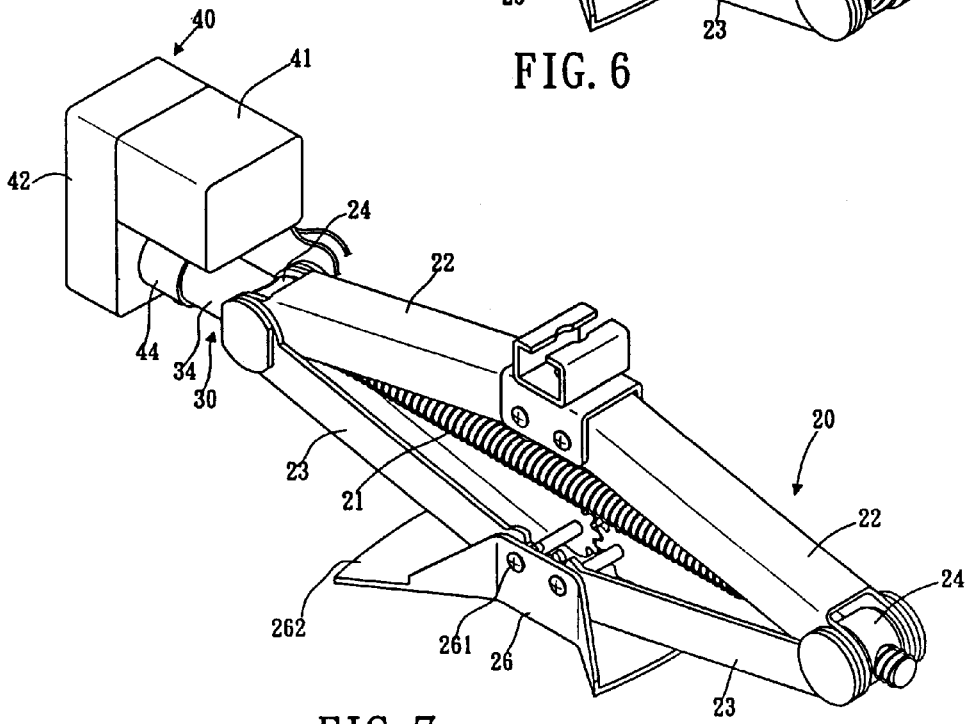
FIG. 7 is an assembled perspective view of the electromotive jack in the present invention.
Figure 8A:
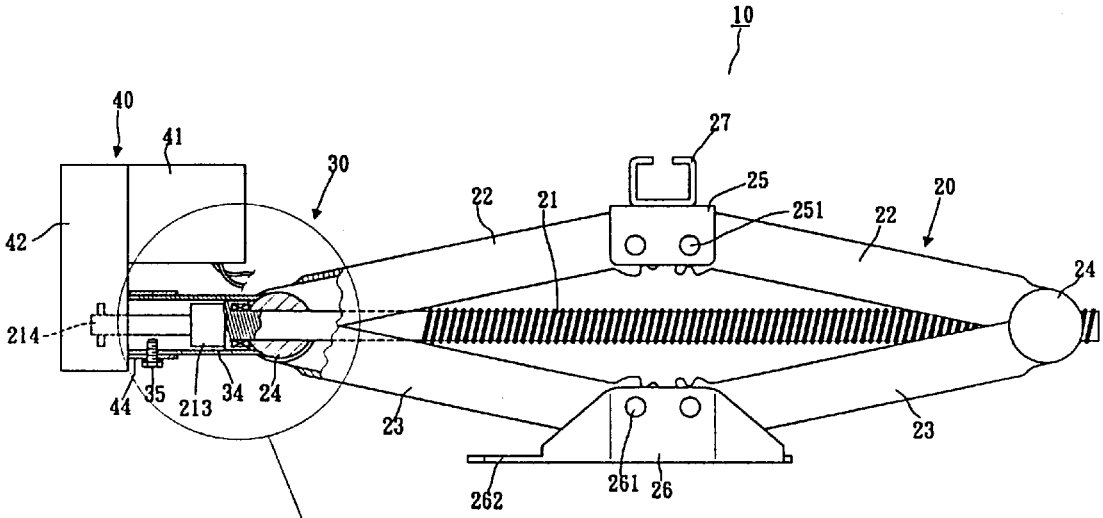
FIG. 8A is an assembled perspective view of the electromotive jack according to the present invention after being assembled.
Figure 8B:
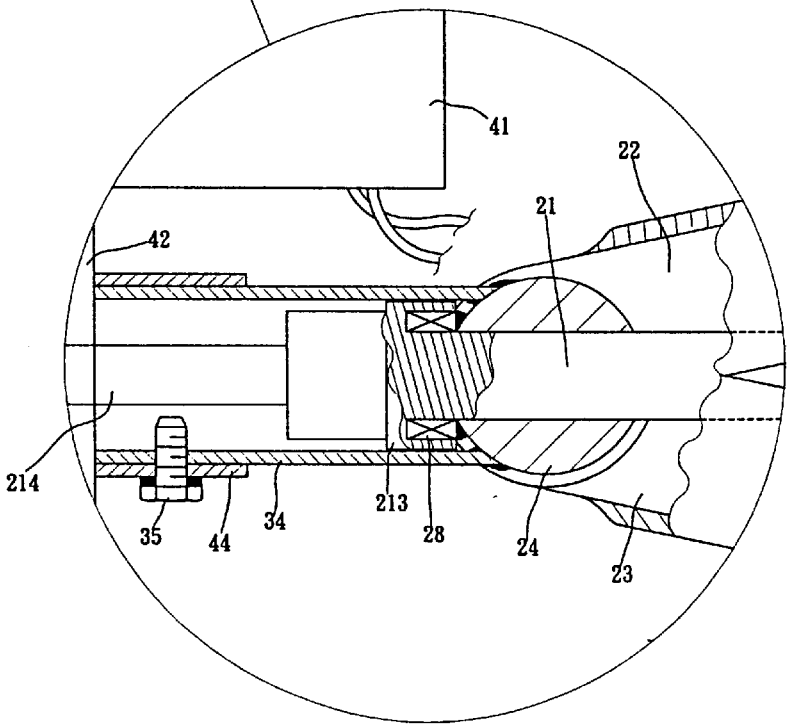
FIG. 8B is an enlarged schematic view of the torsional force releasing means in FIG. 8A.

The structural exploded perspective view and assembly view of another embodiment of the electromotive jack according to to the present invention are illustrated in FIGS. 6 and 7. The difference of this embodiment from the embodiment shown in FIGS. 1 and 2 is that the torsional force releasing means 30 is replaced by a torsional force tube 34 welded to the lateral side of the pivotal shaft of the jack 24. The front side of the electromotive motor 40 is installed with a sleeve 44. After the sleeve 44 is connected with the torsional force tube 34, they can be fixed by a small stud 35 (referring to FIGS. 8A and 8B) or pins. Moreover, one end of the driving screw rod 21 has a bearing cover 213. A bearing 28 is placed in the bearing cover. The bearing 28 is firmly welded to the end portion 214 of the driving screw rod for inserting into the deceleration gearbox 42 so as to be combined with an internal rotary shaft. Next, the small type motor 41 of the electromotive motor 40 is installed within the deceleration gearbox 42 (in prior art, it is installed out of the deceleration gearbox) so as to be formed with an inverse L shape. By this structure, the whole length of the jack can be shortened, and thus the space occupied is reduced.

The aforesaid structure is needless to use a motor positioning plate. Moreover, the torsional force tube 34 serves to release the torsional force or torque generated by the electromotive motor 40 for preventing the jack 30 from instability and thus being tilt.

Figure 9:
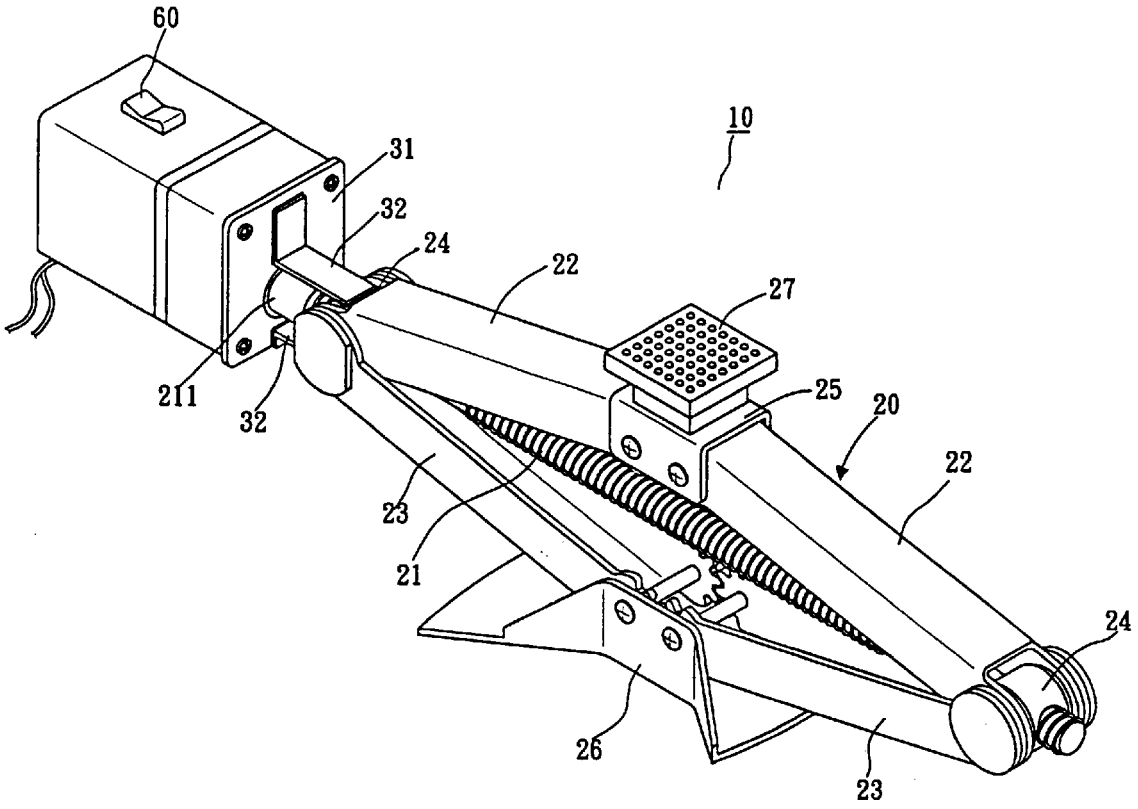
FIG. 9 is a schematic view showing the electromotive jack in the present invention matching with another top pad.

Another embodiment of the electromotive jack of the present invention is illustrated in FIG. 9. The difference of this embodiment from the embodiment shown in FIG. 2 is that the top pad 27 on the connecting block 25 is replaceable. The top pad 27 may be replaced by other top pad of different structure. Next, the arm 32 of torsional force may be formed by symmetric two pieces or a plurality of symmetric pieces. Moreover, the electromotive motor 40 is installed with a switch for switching a DC current to be flown in one of two opposite direction so as to control the rotational direction of the motor.

Figure 11:
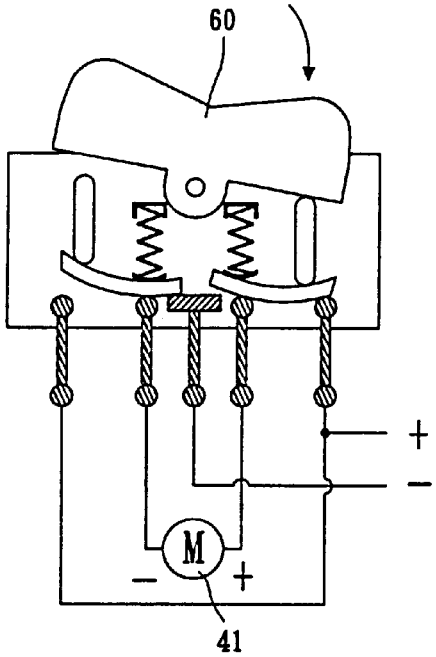
FIG. 11 is a schematic view showing that the motor rotates in another direction reversing to that in FIG. 10 by the control of a DC switch.
Figure 10:
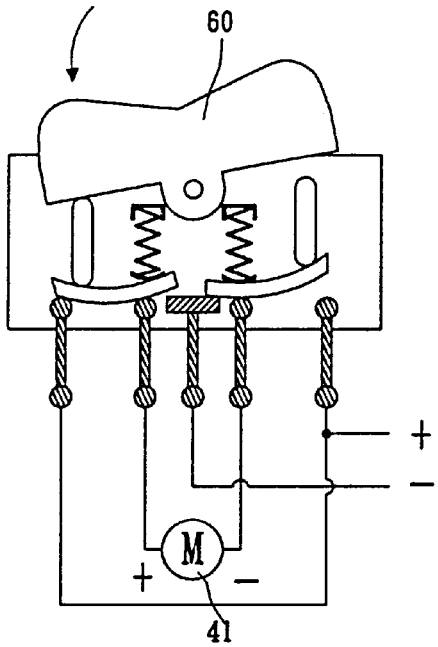
FIG. 10 is a schematic view showing that the motor rotates in one direction by the control of a DC switch.
Figure 12:
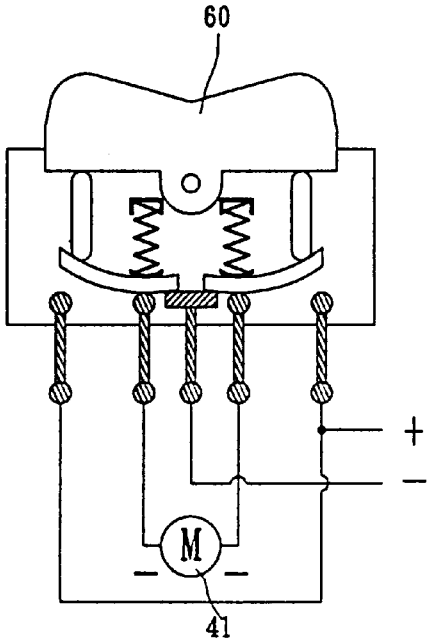
FIG. 12 is a schematic view showing that the motor does not be controlled by a DC switch.

FIGS. 10 to 12 are a schematic view showing the switch for switching the DC current to control the motor. FIG. 10 shows that after the switch 60 is pressed leftwards, the DC motor 60 rotates in one direction. On the contrary, after the switch 60 is pressed rearwards (see FIG. 11), the DC motor 41 rotates in a reverse direction. If the switch 60 do not be pressed (see FIG. 12), then the two polarities will be inputted with negative current to be in a static condition. Furthermore, the DC power source of the motor can be supplied from the battery of a car or a cigar igniter of a car, while the switch can be installed in a motor or a power wire.

Figure 13:
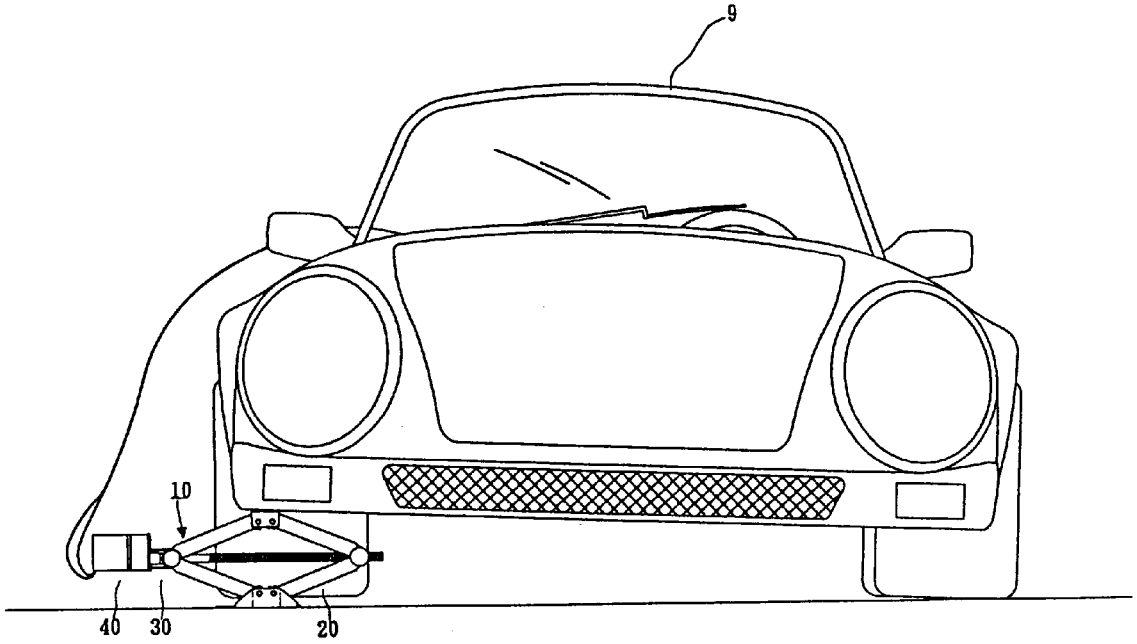
FIG. 13 shows the embodiment of the electromotive jack in the present invention.

FIG. 13 shown another embodiment of the present invention, the jack of the present invention has a light weight and a stable center of gravitation, and thus, can be operated easily. Furthermore, the load can be supported by a DC current. It can be taken easily by a women. Therefore, a heavy load, such a car 9, can be supported easily.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A directly driving electromotive jack device for releasing a torsional force comprising a jack with a driving screw rod, an electromotive motor arranged with a deceleration gearbox, a torsional force releasing means directly connected to a positioning plate and the jack, a power supply directly switch operable by an operator; characteristic in that:

the torsional force releasing means serves to connect the electromotive motor with the jack, the torsional force releasing means comprises a positioning plate for fixing the electromotive motor, two or more than two symmetric arms of torsional force, a bearing for being passed through by the electromotive motor, a switch connected to the driving screw rod, wherein the electromotive motor is fixed to the positioning plate by a plurality of studs; the arms of torsional force serve to connected the positioning plate with pivotal shafts of the jack; the rotary shaft of the electromotive motor and the driving screw rod are positioned in a same central line; the driving screw rod passes through the bearing and the sleeve; the bearing is fixed on the pivotal shafts and is positioned between the pivotal shafts and the sleeve; and the sleeve is connected with the rotary shaft of the electromotive motor;

wherein when the rotary shaft of the electromotive motor rotates, the torsional force is cancelled by the torsional force releasing means for preventing the jack from generating a strain or being tilt; moreover, by a switch of a power source to control the direction of the current flow, the jack can be lifted or descended.

2. A directly driving electromotive jack device for releasing a torsional force comprising a jack with a driving screw rod, an electromotive motor arranged with a deceleration gearbox, a torsional force releasing means directly connected to a positioning plate and the jack, a power supply directly switch operable by an operator; characteristic in that:

the torsional force releasing means serves to connect the electromotive motor with the jack, the torsional force releasing means comprises a torsional force tube fixed to pivotal shafts of the jack, a sleeve fixed at the front end of the electromotive motor, a bearing for being passed through by the driving screw rod; a bearing cover fixed on the driving screw rod and matched to the bearing; wherein after the torsional force tube and the torsional force cover are engaged, then the pivotal shafts of the jack and the electromotive motor are connected and then they are fixed by small studs; moreover, the rotary shaft of the electromotive motor is connected to the driving screw rod of the jack, and they are positioned on the same central line; the driving screw rod passes through the bearing and is connected to the bearing cover; this bearing is fixed to the pivotal shafts and is within the bearing cover;

wherein when the rotary shaft of the electromotive motor rotates, the torsional force is cancelled by the torsional force releasing means for preventing the jack from generating a strain or being tilt; moreover, by a switch of a power source to control the direction of the current flow, the jack can be lifted or descended.

3. The directly driving, electromotive jack device for releasing a torsional force as claimed in claim 2, wherein the electromotive motor is formed by a small type motor and a deceleration gearbox; the small type motor is installed on a wall of the deceleration gearbox and has a shape like an inverse L shape so as to reduce a space to be occupied.

* * * * *